US006520435B1

(12) United States Patent
Robinson

(10) Patent No.: US 6,520,435 B1
(45) Date of Patent: Feb. 18, 2003

(54) PLASTIC BOTTLE SHREDDING ASSEMBLY

(76) Inventor: Harry F. Robinson, 34825 Welbourne Rd., Middleburg, VA (US) 20118

( * ) Notice: Subject to any disclaimer, the term of this patent is extended or adjusted under 35 U.S.C. 154(b) by 193 days.

(21) Appl. No.: 09/765,466

(22) Filed: Jan. 22, 2001

(51) Int. Cl.[7] ..... B02C 19/14
(52) U.S. Cl. ..... 241/99; 241/243
(58) Field of Search ..... 241/99, 225, 243

(56) References Cited

U.S. PATENT DOCUMENTS 3,229,921 A 1/1966 Hess et al.
4,600,158 A 7/1986 Matoba
4,669,673 A 6/1987 Lodovico et al.
4,678,126 A 7/1987 Prentice et al.
4,809,915 A * 3/1989 Koffsky et al. ..... 241/36
4,871,118 A 10/1989 Maloney
5,150,843 A * 9/1992 Miller et al. ..... 241/236
D358,399 S 5/1995 Tiedman et al.

* cited by examiner

*Primary Examiner*—W. Donald Bray

(57) ABSTRACT

A plastic bottle shredding assembly for shredding plastic containers into smaller pieces that take up less physical space. The plastic bottle shredding assembly includes a housing that has an interior space and a loading opening. A rotatable shaft is coupled to the housing that is positioned to extend across the interior space. A motor coupled to the housing is positioned in the interior space. The motor is operationally coupled to the shaft for rotating the shaft. A shredding head is coupled to the shaft such that the shredding head is rotated when the shaft is rotated. A loading door is coupled to the housing for covering the loading opening. The loading door is openable for permitting access to the interior space through the loading opening such that the housing is designed for receiving a plastic bottle in the interior space such that the plastic bottle is shreddable by the shredding head when the motor is activated.

11 Claims, 2 Drawing Sheets

PLASTIC BOTTLE SHREDDING ASSEMBLY

BACKGROUND OF THE INVENTION

1. Field of the Invention

The present invention relates to plastic shredding assemblies and more particularly pertains to a new plastic bottle shredding assembly for shredding plastic containers into smaller pieces that take up less physical space.

2. Description of the Prior Art

The use of plastic shredding assemblies is known in the prior art. More specifically, plastic shredding assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,871,118; 3,229,921; 4,678,126; 4,669,673; 4,600,158; and U.S. Pat. No. Des. 358,399.

While these devices fulfill their respective, particular objectives and requirements, the aforementioned patents do not disclose a new plastic bottle shredding assembly. The inventive device includes a housing that has an interior space and a loading opening. A rotatable shaft is coupled to the housing and is positioned to extend across the interior space. A motor coupled to the housing is positioned in the interior space. The motor is operationally coupled to the shaft for rotating the shaft. A shredding head is coupled to the shaft such that the shredding head is rotated when the shaft is rotated. A loading door is coupled to the housing for covering the loading opening. The loading door is openable for permitting access to the interior space through the loading opening such that the housing is designed for receiving a plastic bottle in the interior space such that the plastic bottle is shreddable by the shredding head when the motor is activated.

In these respects, the. plastic bottle shredding assembly according to the present invention substantially departs from the conventional concepts and designs of the prior art, and in so doing provides an apparatus primarily developed for the purpose of shredding plastic containers into smaller pieces that take up less physical space.

SUMMARY OF THE INVENTION

In view of the foregoing disadvantages inherent in the known types of plastic shredding assemblies now present in the prior art, the present invention provides a new plastic bottle shredding assembly construction wherein the same can be utilized for shredding plastic containers into smaller pieces that take up less physical space.

The general purpose of the present invention, which will be described subsequently in greater detail, is to provide a new plastic bottle shredding assembly apparatus and method which has many of the advantages of the plastic shredding assemblies mentioned heretofore and many novel features that result in a new plastic bottle shredding assembly which is not anticipated, rendered obvious, suggested, or even implied by any of the prior art plastic shredding assemblies, either alone or in any combination thereof.

To attain this, the present invention generally comprises a housing that has an interior space and a loading opening. A rotatable shaft is coupled to the housing that is positioned to extend across the interior space. A motor coupled to the housing is positioned in the interior space. The motor is operationally coupled to the shaft for rotating the shaft. A shredding head is coupled to the shaft such that the shredding head is rotated when the shaft is rotated. A loading door is coupled to the housing for covering the loading opening. The loading door is openable for permitting access to the interior space through the loading opening such that the housing is designed for receiving a plastic bottle in the interior space such that the plastic bottle is shreddable by the shredding head when the motor is activated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out In various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plastic bottle shredding assembly apparatus and method which has many of the advantages of the plastic shredding assemblies mentioned heretofore and many novel features that result in a new plastic bottle shredding assembly which is not anticipated, rendered obvious, suggested, or even implied by any of the prior art plastic shredding assemblies, either alone or in any combination thereof.

It is another object of the present invention to provide a new plastic bottle shredding assembly which may be easily and efficiently manufactured and marketed.

It is a further object of the present invention to provide a new plastic bottle shredding assembly which is of a durable and reliable construction.

An even further object of the present invention is to provide a new plastic bottle shredding assembly which is susceptible of a low cost of manufacture with regard to both materials and labor, and which accordingly is then susceptible of low prices of sale to the consuming public, thereby making such plastic bottle shredding assembly economically available to the buying public.

Still yet another object of the present invention is to provide a new plastic bottle shredding assembly which provides in the apparatuses and methods of the prior art some of the advantages thereof, while simultaneously overcoming some of the disadvantages normally associated therewith.

Still another object of the present invention is to provide a new plastic bottle shredding assembly for shredding plastic containers into smaller pieces that take up less physical space.

Yet another object of the present invention is to provide a new plastic bottle shredding assembly which includes a housing that has an interior space and a loading opening. A rotatable shaft is coupled to the housing that is positioned to extend across the interior space. A motor coupled to the housing is positioned in the interior space. The motor is operationally coupled to the shaft for rotating the shaft. A shredding head is coupled to the shaft such that the shredding head is rotated when the shaft is rotated. A loading door is coupled to the housing for covering the loading opening. The loading door is openable for permitting access to the interior space through the loading opening such that the housing is designed for receiving a plastic bottle in the interior space such that the plastic bottle is shreddable by the shredding head when the motor is activated.

Still yet another object of the present invention is to provide a new plastic bottle shredding assembly that is easy, fast and convenient for a user to quickly shred bulky plastic containers.

Even still another object of the present invention is to provide a new plastic bottle shredding assembly that would make it easier for a user to store and transport plastic containers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
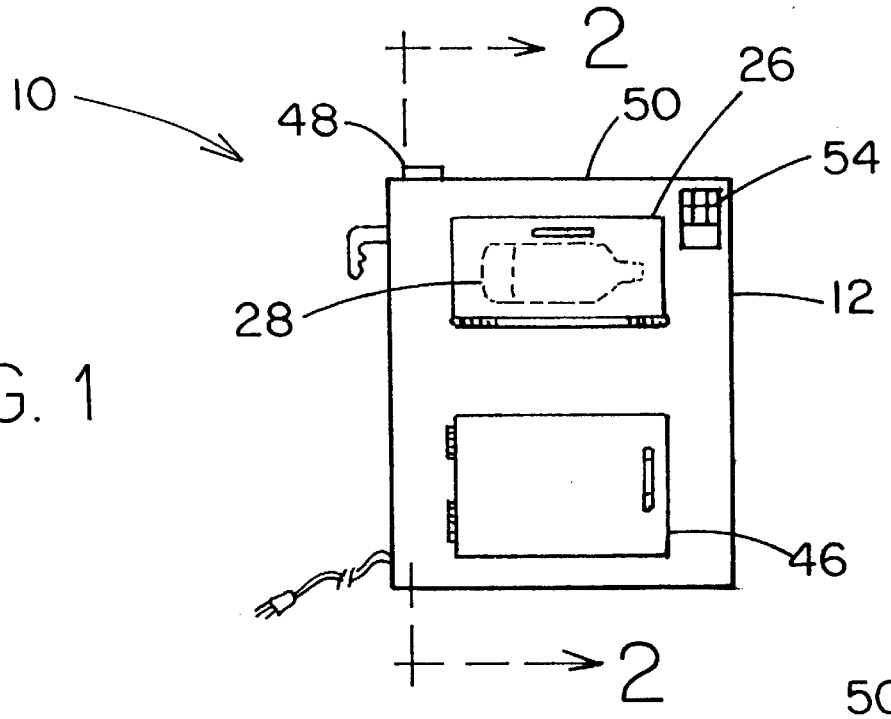
FIG. 1 is a front view of a new plastic bottle shredding assembly according to the present invention.
Figure 4:
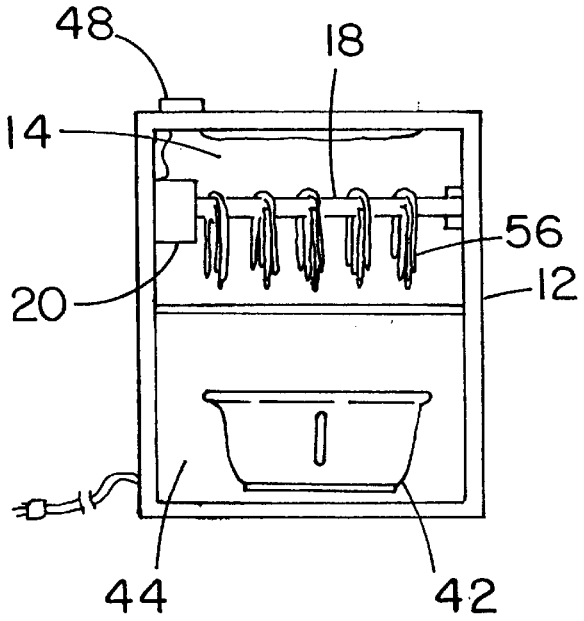
FIG. 4 is a front view of the present invention.
Figure 5:
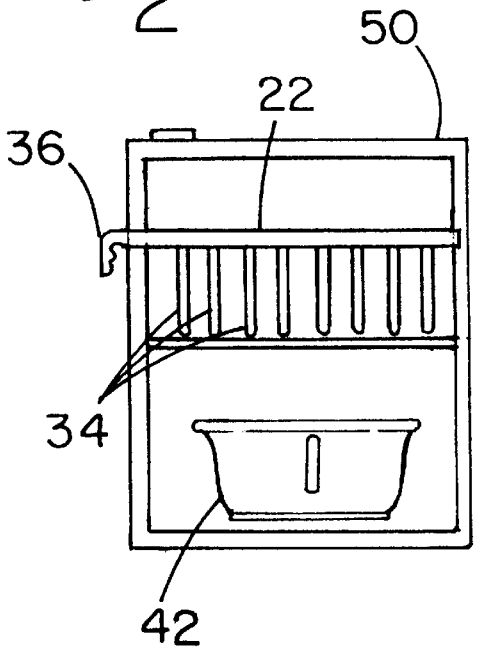
FIG. 5 is a front view of the present invention.
Figure 2:
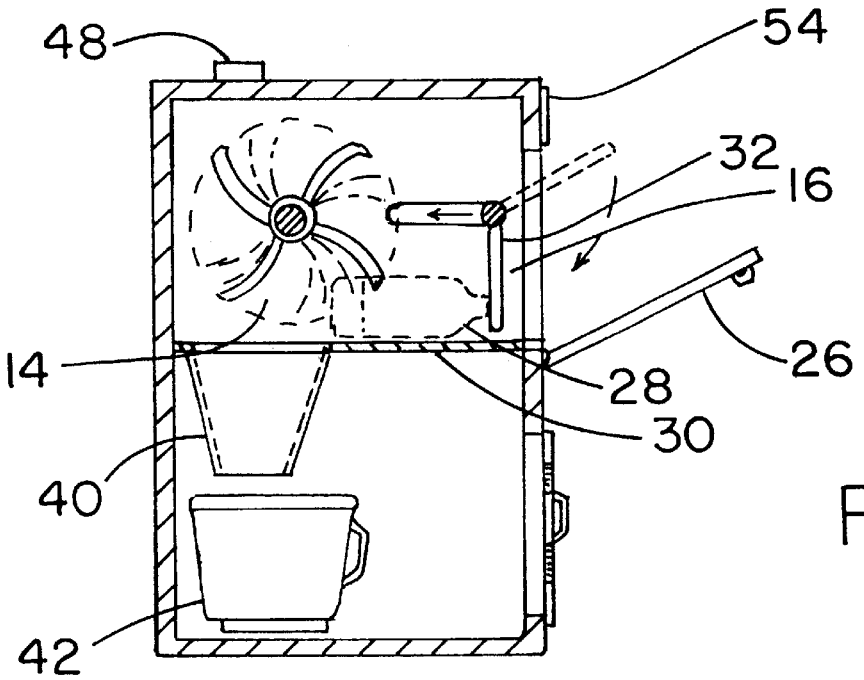
FIG. 2 is a cutaway view of the present invention.
Figure 3:
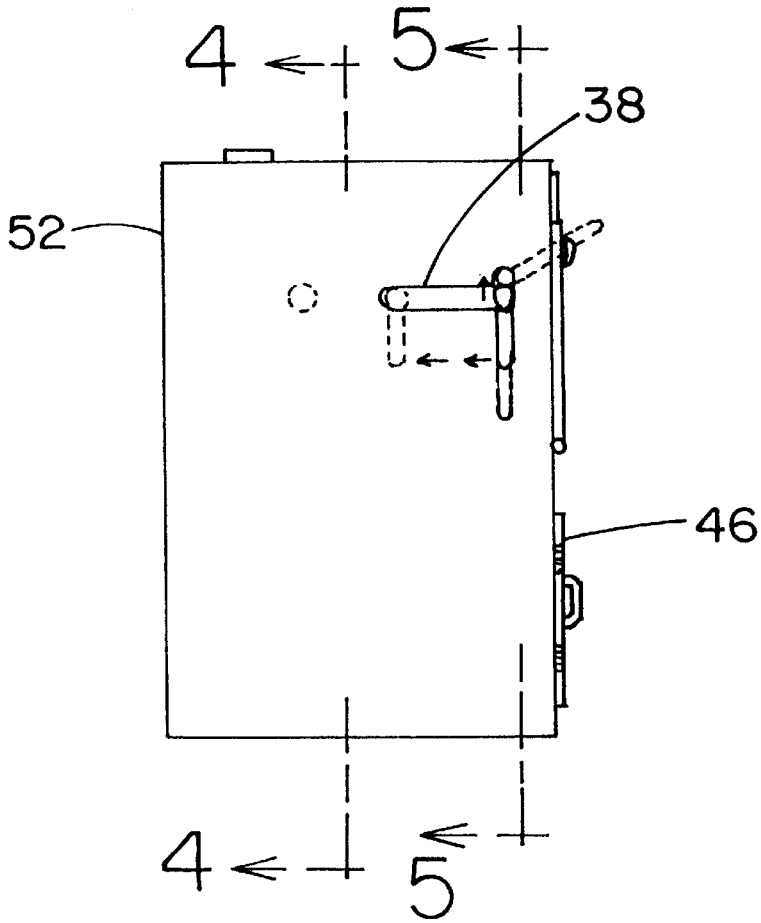
FIG. 3 is a side view of the present invention.

With reference now to the drawings, and in particular to FIGS. 1 through 5 thereof, a new plastic bottle shredding assembly embodying the principles and concepts of the present invention and generally designated by the reference numeral 10 will be described.

As best illustrated in FIGS. 1 through 5, the plastic bottle shredding assembly 10 generally comprises a housing 12 which includes an interior space 14 and a loading opening 16. A rotatable shaft 18 coupled to the housing 12 is positioned to extend across the interior space 14. A motor 20 coupled to the housing 12 is positioned in the interior space 14, the motor 20 is operationally coupled to the shaft 18 for rotating the shaft 18.

A plurality of shredding heads 24 are coupled to the shaft 18 in spaced relationship along a length of the shaft 18 such that the shredding heads 24 are rotated when the shaft 18 is rotated. A loading door 26 coupled to the housing 12 for covering the loading opening 16 is openable for permitting access to the interior space 14 through the loading opening 16. The housing 12 is designed for receiving a plastic bottle 28 in the interior space 14 such that the plastic bottle 28 is shreddable by the shredding heads 24 when the motor 20 is activated.

The shaft 18 is positioned to extend across an upper rearward portion of the interior space 14. A shelf 30 positioned to extend across a forward medial portion of the interior space 14, the loading door 26 is positioned on an upper front portion of the housing 12 whereby the shelf 30 supports the plastic bottle 28 when the plastic bottle 28 its inserted into the interior space 14 through the loading door 26.

The shelf 30 is aligned with a bottom of the loading opening 16. A rod 32 coupled to the housing 12 proximate the loading door 26 extends across the interior space 14 substantially parallel to the shaft 18. A plurality of tines 34 extends from the rod 32, the tines 34 are positioned substantially coplanar with respect to each other.

The rod 32 includes a handle portion 36 that extends through the housing 12 whereby the rod 32 is designed to be rotated by a user for permitting insertion of the plastic bottle 28 through the loading door 26 and urging the plastic bottle 28 towards the shredding heads 24 for facilitating shredding the plastic bottle 28.

The housing 12 includes a pair of slots 38, the rod 32 is slidably coupled to the slots 38 such that the rod 32 is slidable towards the shaft 18 for facilitating urging the plastic bottle 28 towards the shredding heads 24. The tines 34 are spaced such that each of the shredding heads 24 are aligned with an associated gap between an adjacent pair of the tines 34 for preventing the shredding heads 24 from contacting the tines 34.

A chute 40 is positioned in the interior space 14 below the shaft 18 and adjacent the shelf 30 whereby shredded pieces of the plastic bottle 28 are gravitationally urged to pass through the chute 40. A receptacle 42 is positioned in the interior space 14 below the chute 40 for collecting the shredded pieces.

The housing 12 includes a waste disposal opening 44 and a waste disposal door 46 is coupled to the housing 12 for selectively covering the waste disposal opening 44. The waste disposal door 46 is opened for permitting access to interior space 14 for facilitating removal of the receptacle 42 through the waste disposal opening 44.

An activation button 48 is coupled to the housing 12, the activation button 48 is electrically coupled to the motor 20 for selectively activating the motor 20. The activation button 48 is positioned on an upper face 50 of the housing 12 and adjacent to a rear edge 52 of the housing 12 whereby the activation button 48 is positioned to prevent access to the activation button 48 by small children.

A keypad 54 coupled to the housing 12 is electrically coupled to the motor 20 for selectively permitting activation of the motor 20 upon typing a code into the keypad 54 for preventing unauthorized use of the shredding assembly 10.

The shredding head 24 includes a plurality of cutting lines 56 that extend radially outward from the shredding head 24 for cutting the plastic bottle 28 when each of the shredding heads 24 are rotated.

In use, a user would place the plastic container behind the upper door and push the on button to shred the plastic container into small strips that would go into the removable container, behind the lower door.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plastic bottle shredding assembly comprising:

a housing having an interior space and a loading opening;

a rotatable shaft coupled to said housing, said shaft being positioned to extend across said interior space;

a motor coupled to said housing, said motor being positioned in said interior space, said motor being operationally coupled to said shaft for rotating said shaft;

a shredding head coupled to said shaft such that said shredding head is rotated when said shaft is rotated;

a loading door coupled to said housing for covering said loading opening, said loading door being openable for permitting access to said interior space through said loading opening such that said housing is adapted for receiving a plastic bottle in said interior space such that the plastic bottle is shreddable by said shredding head when said motor is activated;

said shaft being positioned to extend across an upper rearward portion of said interior space; and a shelf positioned to extend across a forward medial portion of said interior space, said loading door being positioned on an upper front portion of said housing whereby said shelf supports the plastic bottle when the plastic bottle is inserted into said interior space through said loading door.

2. The plastic bottle shredding assembly of claim 1, further comprising:

a rod coupled to said housing proximate said loading door, said rod extending across said interior space substantially parallel to said shaft;

a plurality of tines extending from said rod, said tines being positioned substantially coplanar with respect to each other;

said rod having a handle portion extending through said housing whereby said rod is adapted for being rotated by a user for permitting insertion of the plastic bottle through said loading door and urging the plastic bottle towards said shredding head for facilitating shredding the plastic bottle.

3. The plastic bottle shredding assembly of claim 2, further comprising:

said housing including a pair of slots, said rod being slidably coupled to said slots such that said rod is slidable towards said shaft for facilitating urging the plastic bottle towards said shredding head.

4. The plastic bottle shredding assembly of claim 1, further comprising:

a chute positioned in said interior space below said shaft and adjacent said shelf whereby shredded pieces of the plastic bottle are gravitationally urged to pass through said chute.

5. The plastic bottle shredding assembly of claim 4, further comprising:

a receptacle positionable in said interior space below said chute for collecting the shredded pieces.

6. The plastic bottle shredding assembly of claim 5, further comprising:

said housing having a waste disposal opening;

a waste disposal door coupled to said housing for selectively covering said waste disposal opening, said waste disposal door being openable for permitting access to interior space for facilitating removal of said receptacle through said waste disposal opening.

7. A plastic bottle shredding assembly comprising:

a housing having an interior space and a loading opening;

a rotatable shaft coupled to said housing, said shaft being positioned to extend across said interior space;

a motor coupled to said housing, said motor being positioned in said interior space, said motor being operationally coupled to said shaft for rotating said shaft;

a shredding head coupled to said shaft such that said shredding head is rotated when said shaft is rotated;

a loading door coupled to said housing for covering said loading opening, said loading door being openable for permitting access to said interior space through said loading opening such that said housing is adapted for receiving a plastic bottle in said interior space such that the plastic bottle is shreddable by said shredding head when said motor is activated; and a keypad coupled to said housing, said keypad being operationally coupled to said motor for permitting activation of said motor only upon typing a code into said keypad for preventing unauthorized use of said shredding assembly.

8. A plastic bottle shredding assembly comprising:

a housing having an interior space and a loading opening;

a rotatable shaft coupled to said housing, said shaft being positioned to extend across said interior space;

a motor coupled to said housing, said motor being positioned in said interior space, said motor being operationally coupled to said shaft for rotating said shaft;

a shredding head coupled to said shaft such that said shredding head is rotated when said shaft is rotated;

a loading door coupled to said housing for covering said loading opening, said loading door being openable for permitting access to said interior space through said loading opening such that said housing is adapted for receiving a plastic bottle in said interior space such that the plastic bottle is shreddable by said shredding head when said motor is activated; and an activation button coupled to said housing, said activation button being operationally coupled to said motor for selectively activating said motor.

9. The plastic bottle shredding assembly of claim 8, further comprising:

said activation button being positioned on an upper face of said housing and adjacent to a rear edge of said housing whereby said activation button is positioned to prevent access to said activation button by small children.

10. A plastic bottle shredding assembly comprising:

a housing having an interior space and a loading opening;

a rotatable shaft coupled to said housing, said shaft being positioned to extend across said interior space;

a motor coupled to said housing, said motor being positioned in said interior space, said motor being operationally coupled to said shaft for rotating said shaft;

a shredding head coupled to said shaft such that said shredding head is rotated when said shaft is rotated;

a loading door coupled to said housing for covering said loading opening, said loading door being openable for permitting access to said interior space through said loading opening such that said housing is adapted for receiving a plastic bottle in said interior space such that the plastic bottle is shreddable by said shredding head when said motor is activated; and said shredding head including a cutting line extending from said shredding head for cutting the plastic bottle when the shredding head is rotated.

11. A plastic bottle shredding assembly comprising:

a housing having an interior space and a loading opening;

a rotatable shaft coupled to said housing, said shaft being positioned to extend across said interior space;

a motor coupled to said housing, said motor being positioned in said interior space, said motor being operationally coupled to said shaft for rotating said shaft;

a plurality of shredding heads coupled to said shaft in spaced relationship along a length of said shaft such that said shredding heads are rotated when said shaft is rotated;

a loading door coupled to said housing for covering said loading opening, said loading door being openable for permitting access to said interior space through said loading opening such that said housing is adapted for receiving a plastic bottle in said interior space such that the plastic bottle is shreddable by said shredding heads when said motor is activated;

said shaft being positioned to extend across an upper rearward portion of said interior space;

a shelf positioned to extend across a forward medial portion of said interior space, said loading door being positioned on an upper front portion of said housing whereby said shelf supports the plastic bottle when the plastic bottle is inserted into said interior space through said loading door;

said shelf being aligned with a bottom of said loading opening;

a rod coupled to said housing proximate said loading door, said rod extending across said interior space substantially parallel to said shaft;

a plurality of tines extending from said rod, said tines being positioned substantially coplanar with respect to each other;

said rod having a handle portion extending through said housing whereby said rod is adapted for being rotated by a user for permitting insertion of the plastic bottle through said loading door and urging the plastic bottle towards said shredding heads for facilitating shredding the plastic bottle;

said housing including a pair of slots, said rod being slidably coupled to said slots such that said rod is slidable towards said shaft for facilitating urging the plastic bottle towards said shredding heads;

said tines being spaced such that each of said shredding heads is aligned with an associated gap between an adjacent pair of said tines for preventing said shredding heads from contacting said tines;

a chute positioned in said interior space below said shaft and adjacent said shelf whereby shredded pieces of the plastic bottle are gravitationally urged to pass through said chute;

a receptacle positionable in said interior space below said chute for collecting the shredded pieces;

said housing having a waste disposal opening;

a waste disposal door coupled to said housing for selectively covering said waste disposal opening, said waste disposal door being openable for permitting access to interior space for facilitating removal of said receptacle through said waste disposal opening;

an activation button coupled to said housing, said activation button being operationally coupled to said motor for selectively activating said motor;

said activation button being positioned on an upper face of said housing and adjacent to a rear edge of said housing whereby said activation button is positioned to prevent access to said activation button by small children;

a keypad coupled to said housing, said keypad being operationally coupled to said motor for selectively permitting activation of said motor upon typing a code into said keypad for preventing unauthorized use of said shredding assembly; and each said shredding head including a plurality of cutting lines extending radially outward from said shredding head for cutting the plastic bottle when each said shredding head is rotated.

* * * * *